United States Patent [19]

Taylor

[11] Patent Number: 4,477,143

[45] Date of Patent: Oct. 16, 1984

[54] ORIENTABLE TWISTLOCK RECEPTACLE

[75] Inventor: Carl D. Taylor, Hendersonville, N.C.

[73] Assignee: General Electric Company, Schenectady, N.Y.

[21] Appl. No.: 446,806

[22] Filed: Dec. 3, 1982

[51] Int. Cl.[3] ..... H01R 13/642

[52] U.S. Cl. ..... 339/126 RS; 339/184 M

[58] Field of Search ..... 339/88 R, 123, 125 R, 339/126 R, 126 RS, 129, 132 R, 132 B, 133 R, 184 R, 184 M

[56] References Cited

U.S. PATENT DOCUMENTS

| | | | |
|---|---|---|---|
| 1,495,778 | 5/1924 | Butzke | 339/123 |
| 2,970,222 | 1/1961 | Husky et al. | 250/239 |
| 3,083,347 | 3/1963 | Fahey, Jr. | 339/184 |
| 3,123,423 | 3/1964 | Schmitt | 339/184 |
| 3,184,199 | 5/1965 | Clark et al. | 248/230 |
| 3,292,135 | 12/1966 | Robinson | 339/196 R |
| 3,379,892 | 4/1968 | Neagle | 250/237 |
| 3,710,130 | 1/1973 | Pate | 250/239 |
| 4,426,676 | 1/1984 | Taylor | 362/371 |

*Primary Examiner*—John McQuade
*Assistant Examiner*—Paula Austin
*Attorney, Agent, or Firm*—Ernest W. Legree; Philip L. Schlamp; Fred Jacob

[57] ABSTRACT

An electrical receptacle of the twist lock type adapted to receive a photoelectric controller can be assembled into a luminaire without requiring the luminaire housing to be turned over and can be oriented in the field without use of tools. The receptacle is retained in an aperture through the housing by a snap ring having tabs on the inside edge which engage ledges in the body portion of the receptacle. The snap ring has leaf springs which hold the receptacle resiliently down against the housing. By lifting up the receptacle, keying pins and recesses in the receptacle and housing are disengaged and the receptacle may be turned to a different orientation.

6 Claims, 3 Drawing Figures

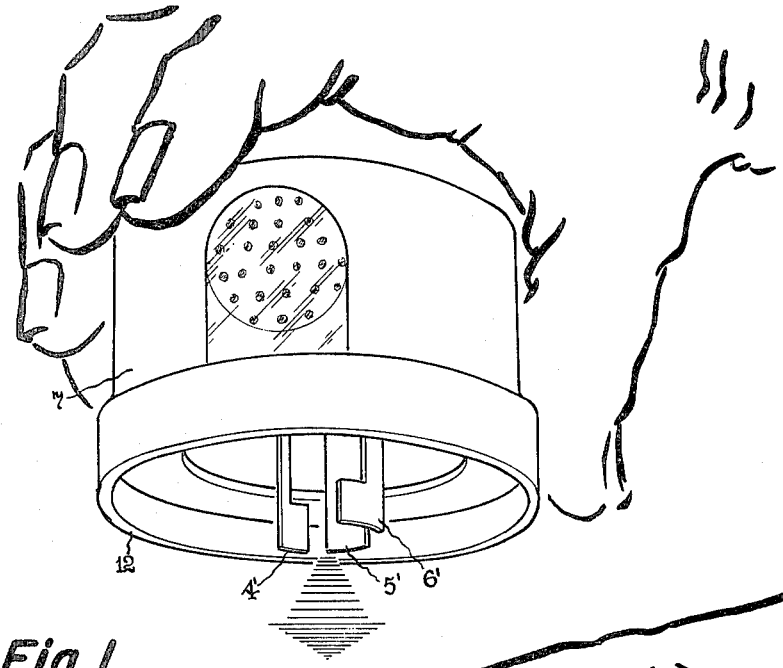
Fig. 1
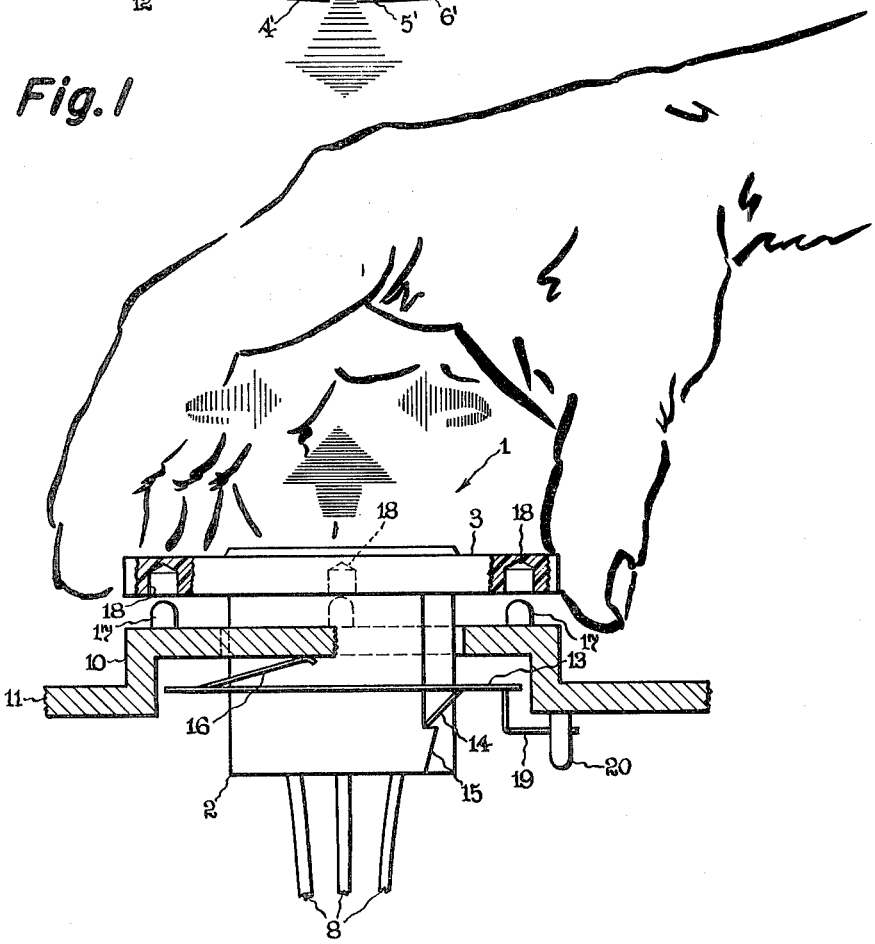

ORIENTABLE TWISTLOCK RECEPTACLE

The invention relates to an improved twist type receptable for the photoelectric controller of an outdoor luminaire.

BACKGROUND OF THE INVENTION

Luminaires of the type used for street lighting are usually provided with a receptacle accommodating a photoelectric controller on top of the housing. The receptacle is wired into the power module or into the line supply to the luminaire. When photoelectric control of the lighting is desired, a controller is plugged into the receptacle. Insertion of the controller into the receptacle is usually done with a downward pressure and a twisting motion causing it to lock in, whence the common appellation twistlock. The controller opens the line circuit in the daytime but closes it at night. When it is desired to control the luminaire in some other way, as from a central switching location, a dummy plug is inserted into the receptacle which shortcircuits appropriate terminals.

When a luminaire equipped with a photoelectric controller is first installed in the field, the controller is ordinarily oriented north (in the northern hemisphere) to insure that the photocell does not receive direct sunlight which could shorten its life. In special situations the controller may be oriented to avoid facing floodlights or other lighting. Orientation of the controller usually requires the use of tools on the part of the installer. With one well-known design of receptacle, it is accomplished by loosening screws in the top of the receptacle, turning the receptacle until an arrow (or the legend N) is aimed toward north, and then tightening the screws again.

General desiderata in receptacle design are ease of assembly into the luminaire at manufacture, convenience of installation or adjustment in the field, combined with minimum number of parts, low cost and reliability. Particularly desirable are features which reduce the burden of field installation because the installer may have to work high above the ground or under precarious conditions.

SUMMARY OF THE INVENTION

One object of the invention is to provide a twistlock receptacle which can be assembled into the luminaire without requiring that the parts or the luminaire housing in which they are being assembled be turned over during manufacture, such being desirable to speed assembly and reduce manufacturing costs.

Another object is to provide a receptacle which does not require the use of tools on the part of the installer in order to orient it to north.

Other objects and advantages will become apparent from this summary and the detailed description and appended claims to follow.

In the illustrated embodiment of the invention, the receptacle comprises a body of insulating material having overreaching shoulders which, together with the body portion, define a top portion. It is inserted up to the shoulders into an accommodating aperture in the luminaire. In accordance with the invention, the receptacle body is held in place relative to the luminaire by retaining means attached to it on the side opposite from the top portion and resiliently holding the underside of the top portion against the housing. In the illustrated embodiment, the retainer is a snap ring provided with tabs on the inside edge and it is simply pressed down on the receptacle body until the tabs engage locking ledges.

According to a feature of the invention, the receptacle is spring retained within the accommodating aperture in a manner which resiliently presses the top portion down against a luminaire housing, and in the preferred embodiment illustrated, this is done by leaf springs in the snap ring which are turned up on the outside edge. By manually lifting up the receptacle, keying protuberances and recesses in the luminaire housing and in the underside of the top portion of the receptacle are disengaged and the receptacle may be turned to the desired orientation.

DESCRIPTION OF THE DRAWINGS

In the drawings:

FIG. 1 is a partly sectioned pictorial view showing in the lower portion a twistlock receptacle embodying the invention with a hand pulling it up to orient it, and in the upper portion, a hand holding a photoelectric controller poised above the receptacle ready for insertion.

DETAILED DESCRIPTION

Figure 3:
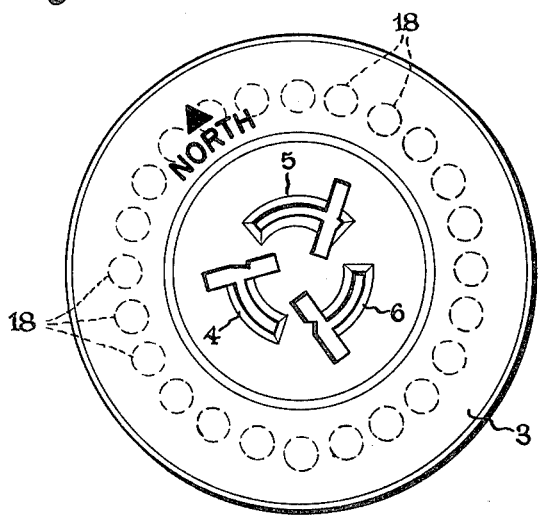
FIG. 3 is a plan view looking down on the receptacle.

As best seen in FIG. 1, twistlock receptacle 1 embodying the invention comprises a generally cylindrical body portion 2 of insulating material having overreaching shoulders. The shoulders, together with the body, form a disc like top portion 3 best seen in FIG. 3. The body portion contains three through passages terminating in arcuate slots 4, 5 and 6 in the top portion. The slots are penetrated by curved male contact members 4', 5' and 6' of photoelectric controller 7 shown hand-held poised above the receptacle. The passages contain self-captivating terminals (not shown) to which are attached the wires 8 hanging down from the body portion. Reference may be made to copending application Ser. No. 301,481, filed Sept. 11, 1981 by Plemmons and Blake, now abandoned, entitled Twist Type Electrical Receptacle and assigned to the same assignee as the present invention for a more detailed description of the passages and terminals within the receptacle body.

The receptacle is seated on a circular embossment 10 raised slightly above the top surface 11 of the luminaire housing which is commonly an aluminum casting. Reference may be made to my copending application Ser. No. 446,807, filed of even date herewith, entitled Luminaire Mounting and assigned to the same assignee as the present invention, now U.S. Pat. No. 4,426,676, for a description of a street lighting luminaire in which the present receptacle may be accommodated. The photoelectric controller, or alternatively the male dummy plug when no controller is used, has a dependent skirt 12 which overreaches the edge of embossment 10 to seal out rain and soil. The receptacle is kept centered on embossment 10 by the size of the aperture through the embossment and its fit around the body portion of the receptacle.

Figure 2:
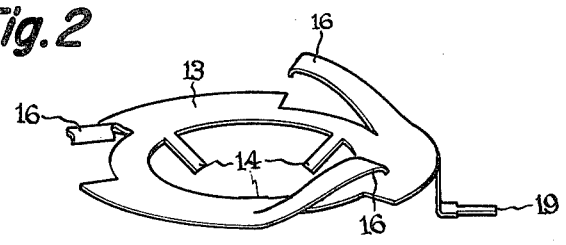
FIG. 2 is a pictorial view of the snap ring retainer.

The receptacle is retained on the housing by snap ring 13 shown in FIG. 2. The ring is made of spring stock adequately resistant to corrosion, suitably spring stainless steel and has three tabs 14 turned down on the inside edge. These tabs ride over and engage ledges 15 located between the lobes of body portion 2 of the receptacle, thereby locking the snap ring to the receptacle.

The snap ring has three leaf springs 16 turned up on the outside edge. They apply pressure to the housing to hold the receptacle snugly seated against the embossment 10. Keying pins or protuberances 17 in the top surface of embossment 10 normally engage cavities, suitably blind holes 18 in the undersurface of top portion 3 of the receptacle. By lifting up the receptacle against the pressure of the leaf springs, the pins are disengaged from the holes as shown in FIG. 1, and the receptacle may be turned in either direction to orient it. Upon releasing the receptacle, it seats and locks in place. The pressure exerted by leaf springs 16 determine the "feel" as the installer adjusts the twistlock receptacle to north. The leaf spring design must of course be correlated to the height of the ledges 15 and the spacing between snap ring 13 and the underside of circular embossment 10 to provide the proper operation and "feel".

The number of blind holes 18 in top portion 3 will determine the permissible increment of adjustment in orientation. With 24 blind holes, orientation by 15° increments may be had. Preferably 4 keying pins 17 are provided at 90° intervals for stability so the receptacle will not tend to tip as it is lifted and rotated. A tab 19 off the side of the snap ring limits the rotation of the receptacle by butting into a pin 20 cast in the underside of the luminaire housing. This prevents the installer from twisting the receptacle around and around several times and accidentally pulling wires 8 loose from their attachments.

The receptacle design in accordance with the invention greatly simplifies the assembly procedure. One of the most burdensome tasks in assembling luminaires is having to locate parts on one side and then having to turn the luminaire housing over in order to attach screws or fastening devices. The situation where parts have to be assembled from both sides is equally bad if not worse. Such problems are entirely avoided by the improved receptacle design of the invention. For assembly into a luminaire, the receptacle of the invention is put down on a work table or suitable platform, the luminaire housing is placed over it with the inside or under surface turned up on the normal position for receiving the ballast and optical components. The receptacle is locked in place simply by pressing the snap ring down upon it until the tabs in the ring engage the ledges in the receptacle body. With this simple operation the receptacle is fully assembled and requires no further attention. When the installer of the luminaire in the field comes to orient the receptacle, he can hand orient it without any use of tools. Usually the receptacle is oriented only when a photoelectric controller is installed. It is easier then to plug and lock the controller into the receptacle first, as the controller then gives a better grip for lifting the receptacle up from the housing to orient it as needed.

While the invention has been described with reference to a particular embodiment thereof, it will be understood that various modifications may be made by those skilled in the art without departing from the invention. To mention but the most obvious, there are other ways of holding the snap ring onto the receptacle body. For instance one may use a snap ring having sharp protrusions at the inside edge which bite into the plastic material of the receptacle body as it is forcibly pushed on. It will be obvious, too, that the location of keying pins and blind holes as between the luminaire embossment and the undersurface of the disc portion of the receptacle may be interchanged. The appended claims are intended to cover all such equivalent variations coming within the true spirit and scope of the invention.

What I claim as new and desire to secure by Letters Patent of the United States is:

1. An electrical receptacle of the twistlock type adapted to receive a photoelectric controller, comprising:

a body portion of insulating material having overreaching shoulders which together with the body portion define a disc-like top portion, said body portion being insertable into an accommodating aperture in a luminaire housing, through passages in said body portion terminating in arcuate slots in said top portion, said passages containing terminals accessible through said slots to male terminals of the photoelectric controller, retaining means for resiliently holding the underside of said top portion against said housing, and keying protuberances and cooperating cavities in said underside and said housing normally locking the receptacle in one orientation but allowing it to be turned to a different orientation when disengaged by lifting said top portion away from the housing.

2. A receptacle as in claim 1 wherein the keying protuberances are in the housing and the cooperating cavities are in the underside of the top portion formed by the overreaching shoulders.

3. A receptacle as in claim 1 wherein said holding means comprises a snap ring attachable to the receptacle by pressing it down around the body portion after said body portion has been inserted through said aperture.

4. A receptacle as in claim 3 wherein said snap ring has tabs on the inside edge, and said body portion has ledges engageable by said tabs to lock the snap ring to the body.

5. A receptacle as in claim 3 wherein said snap ring has leaf springs turned up to press against the underside of said housing.

6. A receptacle as in claim 4 wherein said snap ring has tabs on the inside edge and leaf springs turned up to press against the underside of said housing, and said body portion has ledges engageable by said tabs to lock the ring to the body at a spacing from the underside of said housing allowing compression of said leaf springs when lifting said top portion.

* * * * *